United States Patent [19]

Kostov

[11] 4,219,214

[45] Aug. 26, 1980

[54] SKI BRAKE

[76] Inventor: Dimitar C. Kostov, 36 N. Spring Blvd., Tarpon Springs, Fla. 33589

[21] Appl. No.: 861,717

[22] Filed: Dec. 19, 1977

[51] Int. Cl.[2] ..... A63C 7/10

[52] U.S. Cl. ..... 280/605; 280/809

[58] Field of Search ..... 280/605, 604, 615, 11.37 G; 188/5

[56] References Cited

FOREIGN PATENT DOCUMENTS

| | | | |
|---|---|---|---|
| 443499 | 4/1927 | Fed. Rep. of Germany | 280/605 |
| 735464 | 5/1943 | Fed. Rep. of Germany | 280/604 |
| 2641763 | 3/1978 | Fed. Rep. of Germany | 280/605 |
| 399316 | 10/1942 | Italy | 280/605 |
| 187456 | 11/1936 | Switzerland | 280/605 |
| 218388 | 3/1942 | Switzerland | 280/605 |

*Primary Examiner*—David M. Mitchell

*Attorney, Agent, or Firm*—Arthur W. Fisher, III

[57] ABSTRACT

A ski brake of the type used to slow or totally stop the movement of skis through an ice or snow covered surface through the provision of a pair of brake plates including spaced apart teeth thereon interconnected to a base means and rotatably positionable upon interaction with the binding with an activation member such that the plurality of teeth affixed to each braking plate is forced into engagement with the snow thereby forcing snow between the teeth and causing frictional reaction and engagement between the trapped snow between teeth and the snow contiguous to the positioned braking plates and secured teeth. A manually operated handle may further activate the braking plates into its braking position independent of predetermined positioning or operation of the binding facility.

6 Claims, 8 Drawing Figures

SKI BRAKE

This invention is new and useful.

It permits the skier to control the speed, and stop on the narrow and icy road, whereas the application of the conventional ski technique is impossible.

Another very important object is to prevent the ski from sliding backwards when the skier walks straight, goes uphill or side ways, or runs.

For this purpose the skier now applies different kinds of waxes. Because of weather, temperature and changes of snow the efficiency of the wax is lost.

Other objects and advantages of my invention will be apparent from the following description and from the drawing in which.

Figures 1, 2, 3, 4, 5, 6, 7, 8:
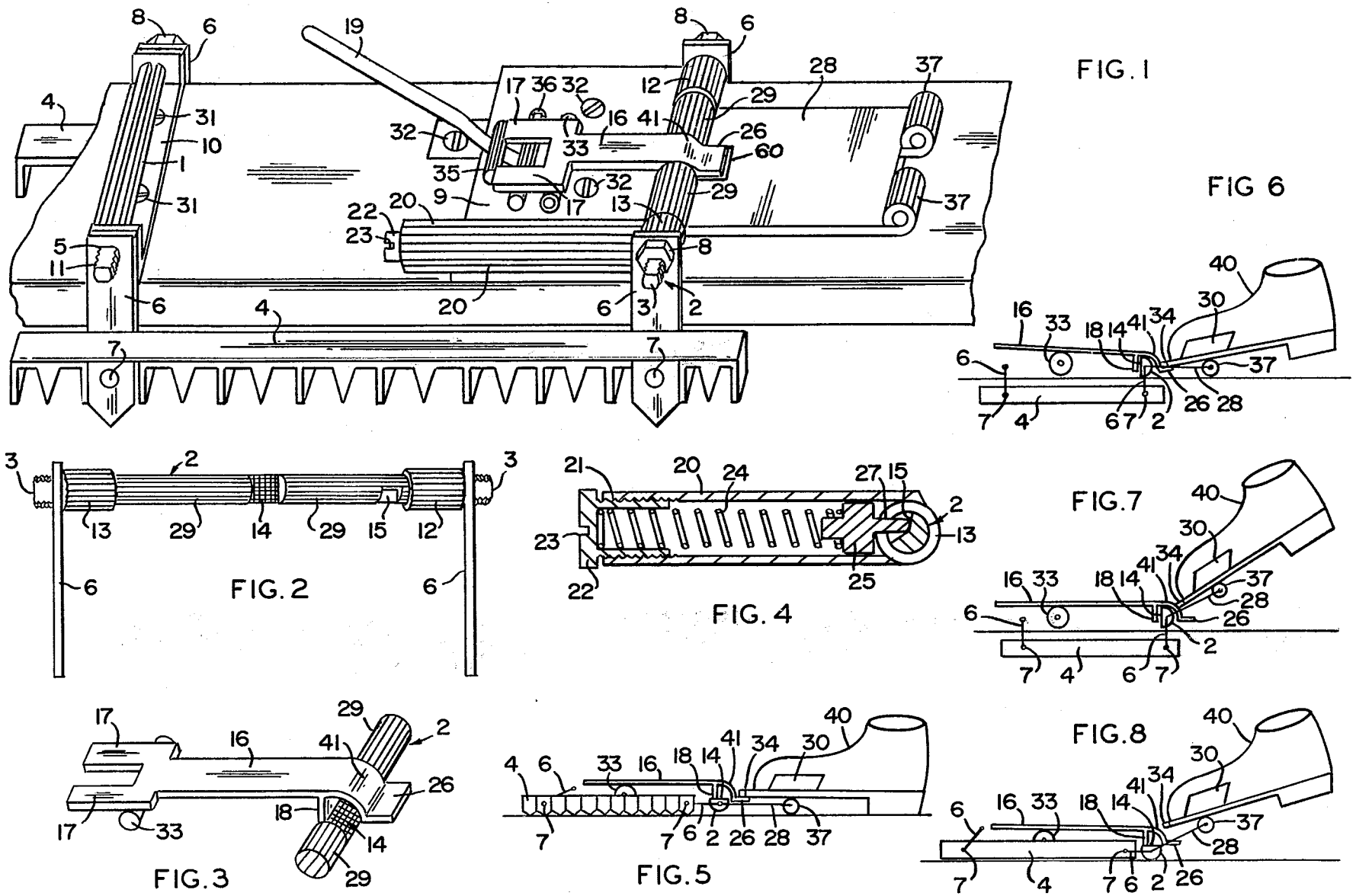
FIG. 1 is a perspective view of the ski brake of the present invention with the brake plates in braking position.
FIG. 2 is a detailed view in perspective of components of the ski brake assembly of the present invention.
FIG. 3 is a detailed view in partial cutaway showing interaction of certain components of the ski brake of the present invention.
FIG. 4 is a sectional view showing the interior of certain components of the ski brake assembly.
FIG. 5 is a detailed view in partial schematic showing a ski binding, boot in relation to the brake assembly.
FIGS. 6, 7 and 8 are all schematic views showing the relative positions of the boot, ski binding and brake assembly in operation.

Referring now to the drawing in detail, it will be seen that the embodiment of FIG. 1 of the invention which has been illustrated comprises two toothed plates 4 fixed in parallel relation on both sides of each ski.

Each toothed plate is attached to axle 1 and axle 2 by four links 6.

The links pivot at their lower ends and are connected to toothed plate 4 with rivets 7.

The upper ends of the links 6 are keyed to axles 1 and 2 with square holes 5 and are fastened with nuts 8. The axles 1 and 2 have square threaded extensions on both ends thereof. These extensions 3 are provided with tubes 35 as shown in FIG. 2, the lengths of the tubes 35 may vary dependent upon the width of the attached ski.

Axle 1 is attached to the front mounting plate 10. The plate 10 is fixed to the ski with screws 31. Axle 2 is hinged to brake base 9 with hinges 12 and 13. Said plate is fixed to the ski with screws 32. Axle 2 is provided with steps 14 and 15 as best shown in FIG. 2.

Activating member 16 is movably attached to the brake base by hinges 33. A distal end of the activating member 16 is provided with two wings 17 as shown in FIG. 1 and at the other end with extension means 18 and end portion (FIG.3) 26.

Brake base 9 includes pivot handle 19 attached thereto as shown in FIG. 1. Handle 19 is provided with pin 35 at its lower end and is pivotally attached to the brake base 9 with hinges 36.

Tube or barrel 20 as shown in FIG. 4, is open at one end and internally threaded as indicated at 21 to fit screw 22. The screw 22 comprises at its external end a kerped head 23 for receiving a screwdriver. Spring 24 disposed on the inside of tube 20 is of a coil type, and at one end engages plunger 25. The other end is attached to screw 22 such that rotating of screw 22 adjusts the tension of the spring 24.

The other end of tube 20 is firmly connected with hinge 13. The inner side of hinge 13 is provided with opening 27. The opening 27 permits the end of plunger 25 to extend therethrough to engage step 15.

Binding mount 28 is hinged as at 29 to axle 2. The opposite other end of mount 28 is pivotally attached to a ski binding 30 by hinge 37 as shown in FIG. 1 and FIG. 5.

The ski brake is used in two ways either by foot or by hand. The brake is operated by foot when it is desired to control the speed when walking or running.

The ski binding 30 is hinged at one end of binding mount 28 by hinge 37. The frontmost end 34 of the binding extends beyond the toe of the boot 40, see FIG. 5. When the skier walks, the heel side of the binding 30 goes up approximately 15°, see FIG. 6. The toe side of the binding goes down and the end 34 of the binding presses end portion 26. At the same time extension means (FIG. 5) which is on the top of the rear edge of step 14, goes down (FIG. 6) and turns axle 2 approximately 90°. Step 15 of axle 2 (FIG. 4) also turns approximately 90°. The edge of the step 15 presses the plunger 25 and places tension on or tightens spring 24. Axle 2 turns links 6 to 90° and then the toothed plates 4—4 are forced into the snow causing the ski to brake. Other structural features of the present invention include an aperture means 60 integrally formed in binding mount 28 in corresponding or substantially aligned position to end portion 26. This permits the pivotal movement of the binding mount 28 as the end portion 26 passes through aperture means 60. (See FIGS. 6, 7 and 8). Accordingly binding mount 28 does not bind on end portion 26 as the pivotal movement of the binding mount 28 occurs.

The heel end of the binding 30 can rotate upwardly approximately 90°. When the heel reaches about 15° the end of the binding 30 presses the end portion 26 forcing it down (FIG. 6).

When the heel of boot 4 raises (FIG. 7) end 34 of the binding 30 and binding mount 28 together begin to raise. The end 34 of the binding, slides up curvilinear portion 41 and maintains pressure thereon keeping end portion 26 depressed. This action prevents extension means 18 from releasing axle 2 and maintains brake plates 4 in their downward braking position.

The downward movement of heel portion of boot 40 allows release of downward pressure by the end 34 of binding 30 (FIG. 8) on end portion 26 or portion 41. This releases completely extension means 18. Simultaneously spring 24 presses plunger 25 thereby turning axle 2 and causing the toothed plates 4 to be positioned in the non-braking position out of the snow.

Handle 19 is operated by hand when traveling uphill. The lifting of handle 19 causes, pin 35 to raise wings 17—17 and blocks them in the raised position, extension 1 means 18 presses the edge of step 14, axle 2 rotates to 90°, and puts the toothed plates in the snow in braking position.

Release of handle 19 causes spring 24 to be released and presses plunger 25. Plunger 25 rotates axle 2 by engagement with step 15, and the toothed plates rotate to the initial non-braking position.

The foregoing is considered as illustrative only of the principles of the invention. Further, since numerous modifications and changes will readily occur to those skilled in the art, it is not desired to limit the invention to the exact construction and operation shown and described, and accordingly all suitable modification and equivalents may be resorted to, falling within the scope of the invention as claimed.

What is claimed as new is as follows:

1. A ski brake of the type operable by a ski binding with a base plate pivotally attached to the ski including a forwardmost end extending beyond a boot secured to the ski binding and used to decrease speed and stop a ski to which the brake is attached, said ski brake comprising: base means secured to the upper surface of the ski, a pair of brake plates movably interconnected to said base means and disposed on opposite sides of the ski in substantially parallel relation to one another, at least one axle rotatably secured to said base means and interconnected to said brake plates so as to effectively rotate therewith, an activating member mounted on said base means and having one end portion extending into interruptive engagement with the forwardmost end of the base plate of the ski binding, said activating member including an extension means projecting towards said one axle into interruptive, abutting relation to at least a first step portion of one axle, said activating member, said one axle and said one step portion disposed relative to one another and the binding secured to the ski to cause pivoting of said axle and consequent disposition of said pair of brake plates into braking engagement with the supporting surface on which the subject ski is positioned as said binding pivots.

2. A ski brake as in claim 1 wherein said activating member further comprises a pair of wing elements integrally secured to another end thereof, handle means including a pin element secured thereto and positionable into engageable relation with said wing elements, said extension means disposable into interruptive engagement with said one stepped portion upon manipulation of said handle means, whereby said pair of brake plates are forced into braking engagement with the supporting surface on which the subject ski is positioned.

3. A ski brake as in claim 1 wherein each of said brake plates comprises a plurality of teeth disposed in spaced apart relation to one another, said teeth of each brake plate disposed and configured to force snow therebetween when said brake plates are forced into braking engagement with a snow covered surface on which the ski is supported.

4. A ski brake as in claim 1 further comprising biasing means including at least one spring assembly disposed into biasing engagement with said one axle and disposed relative thereto to bias said one axle in a brake plate retracted position.

5. A ski brake as in claim 4 comprising a second stepped portion formed on said one axle and disposed in interruptive engagement with said one spring assembly, said biasing means disposed to force said one axle and said attached brake plate into retracted position upon disengagement of the binding with said actuating member.

6. A ski brake as in claim 1 comprising at least two axles both rotatably attached to said base and interconnected to said brake plates, a plurality of links rotatably attached in interconnected relation to both said brake plates and said two axles.

* * * * *